United States Patent [19]

Ninomiya

[11] Patent Number: 4,640,254

[45] Date of Patent: Feb. 3, 1987

[54] AIR-FUEL RATIO CONTROL SYSTEM

[75] Inventor: Masakazu Ninomiya, Kariya, Japan

[73] Assignee: Nippondenso Co., Ltd., Kariya, Japan

[21] Appl. No.: 772,407

[22] Filed: Sep. 4, 1985

[30] Foreign Application Priority Data

Sep. 5, 1984 [JP] Japan ..... 59-186798

[51] Int. Cl.[4] ..... F02M 51/00; F02M 7/06

[52] U.S. Cl. ..... 123/492; 123/480; 123/486; 123/493

[58] Field of Search ..... 123/492, 493, 480, 486

[56] References Cited

U.S. PATENT DOCUMENTS

| | | | |
|---|---|---|---|
| 4,401,087 | 8/1983 | Ikeura | 123/492 |
| 4,416,237 | 11/1983 | Aoki et al. | 123/492 |
| 4,440,119 | 4/1984 | Kobayashi et al. | 123/492 |
| 4,469,074 | 9/1984 | Takao et al. | 123/492 |
| 4,513,723 | 4/1985 | Ishikawa et al. | 123/492 |
| 4,527,529 | 7/1985 | Suzuki et al. | 123/492 |
| 4,528,964 | 7/1985 | Kashiwaya et al. | 123/492 |

*Primary Examiner*—Raymond A. Nelli

*Attorney, Agent, or Firm*—Cushman, Darby & Cushman

[57] ABSTRACT

An air-fuel control system determines a basic injection amount for steady operation in accordance with an engine speed and an intake manifold pressure or intake air amount of the engine, and compensates during a transient period of engine operation the basic injection amount in accordance with engine operating conditions such as throttle valve opening, $O_2$ concentration in the exhaust gas, etc. At the time of engine acceleration, the fuel increment is incrementally compensated for in accordance with the air-fuel ratio immediately before the acceleration, data for fuel increment being stored in a map corresponding to data of the basic injection amount.

23 Claims, 8 Drawing Figures

AIR-FUEL RATIO CONTROL SYSTEM

BACKGROUND OF THE INVENTION

The present invention relates to an air-fuel control system used for controlling the operation of an engine.

One type of the air-fuel ratio control system for supplying a mixture gas of a predetermined air-fuel ratio to the combustion chamber of an engine of an automobile or like is an electronically-controlled fuel injection system. This system comprises either one injector, or as many injectors as the engine cylinders arranged on the intake manifold or throttle body of the engine. The valve-opening time of the injectors is controlled in accordance with the operating conditions of the engine to supply a mixture gas of a predetermined air-fuel ratio to the combustion chamber of the engine. The electronically-controlled fuel injection system is generally classified into two types. In an intake air amount type, a basic injection amount is determined in accordance with the engine intake air amount and the engine. An intake mainfold pressure type, determining a basic injection amount in accordance with the engine intake manifold pressure and engine speed.

On the other hand, a method for finely controlling the air-fuel ratio of the mixture gas supplied to the engine in accordance with the operating conditions of the engine is disclosed in Japanese Patent Publication Laid-Open No. 59330/83. In the system disclosed in the publication, the air-fuel ratio controlled ranges from 14 to 22 in accordance with the operating condition determined by engine speed and intake manifold pressure, thus covering a region for control with a leaner mixture gas than that of the stoichiometric air-fuel ratio.

The fuel enrichment at the time of acceleration of the engine comprising an air-fuel control system with such an electronically-controlled fuel injection system as mentioned above, as described in Japanese Patent Publication Laid-Open No. 144632/83, is controlled by being compensated in accordance with the change rate of the engine conditions represented by the intake manifold pressure or intake air throttle valve opening. The greater the acceleration rate, the fuel enrichment is increased more to prevent dilution of the mixture gas during acceleration, so that a proper fuel enrichment is achieved as long as the air-fuel ratio is set to the stoichiometric level in steady operation.

The fuel enrichment during acceleration specified in the cited Japanese Patent Publication Laid-Open No. 144632/83, however, is conditional on the setting of a stoichiometric air-fuel ratio. If the fuel amount is increased for acceleration while the air-fuel ratio is changed between 14 and 22 in accordance with the engine operating conditions as disclosed in Japanese Patent Publication Laid-Open No. 59330/83, an acceleration from a lean mixture gas would cause a shortage of the fuel enrichment below the desired level for the low air-fuel ratio, resulting in an insufficient acceleration performance and drivability. If acceleration is started from a rich mixture gas, by contrast, the fuel enrichment would exceed the desired enrichment level, so that the mixture gas becomes excessively rich thereby to pose the problem of an abnormally increased amount of carbon monoxide in the exhaust gas.

SUMMARY OF THE INVENTION

Accordingly, it is the object of the present invention to provide an air-fuel ratio control system in which against any air-fuel ratio for steady operation, proper fuel enrichment is always possible so that satisfactory acceleration performance and exhaust gas purification are obtained at the same time.

In order to solve the above-described problems, there is provided an air-fuel ratio control system according to the present invention, in which the air-fuel ratio of the mixture gas supplied to the engine is set by a basic processing means for determining a basic injection amount in accordance with the intake manifold pressure or intake air amount and the engine speed, and a fuel injection amount is determined by the means for compensating for the basic injection amount in accordance with the engine operating conditions during the transient periods thereby to control the air-fuel ratio of the mixture gas, the compensation means comprising means for compensating for the fuel enrichment at the time of acceleration in accordance with the set air-fuel ratio immediately before the acceleration.

DESCRIPTION OF THE PREFERRED EMBODIMENTS

Figure 1:
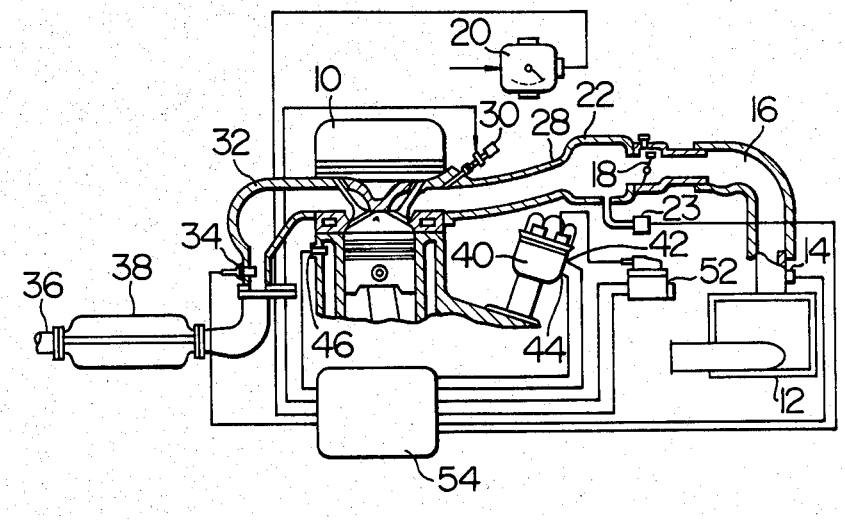
FIG. 1 is a diagram schematically showing a configuration of an air-fuel ratio control system using an electronically-controlled fuel injection system of intake manifold pressure type according to an embodiment of the present invention.
Figure 2:
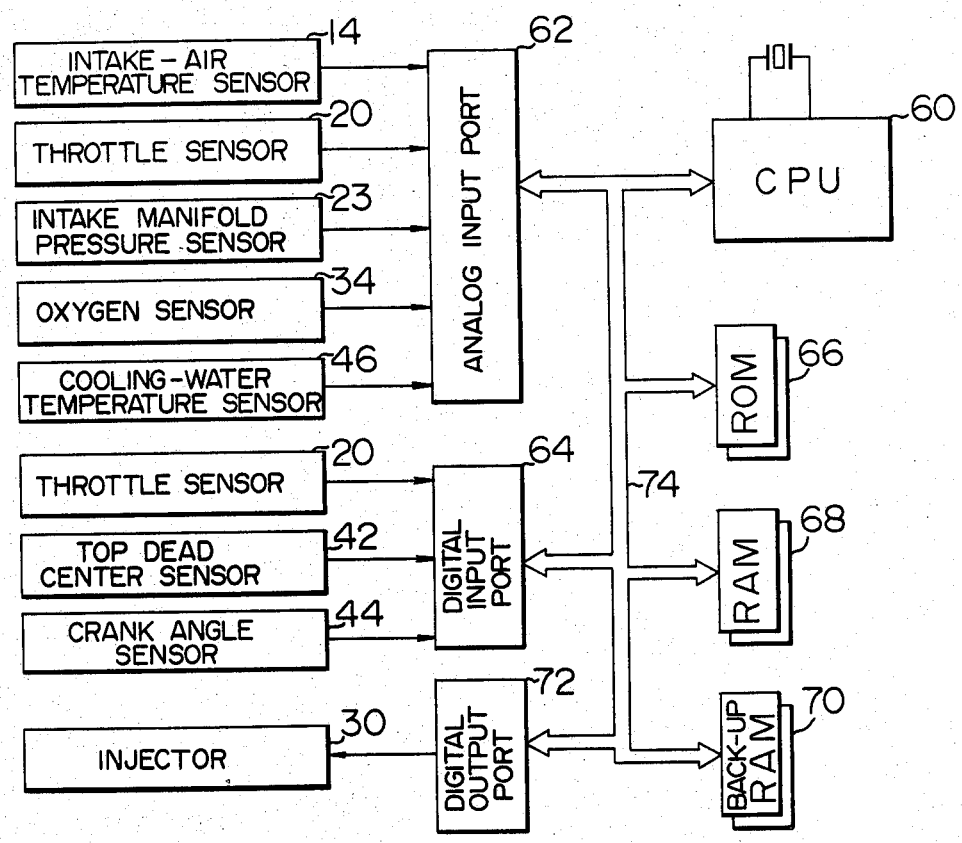
FIG. 2 is a block diagram showing a configuration of a digital control circuit used in the above-mentioned embodiment.

An air-fuel ratio control system using an electronically-controlled fuel injection system of intake manifold pressure type according to an embodiment of the present invention will be described. As shown in FIGS. 1 and 2, an automotive engine 10 according to the present embodiment comprises an air cleaner 12 for cleaning the atmospheric air, an intake air temperature sensor 14 for detecting the temperature of an intake air introduced from the air cleaner 12, a throttle valve 18 arranged in an intake air path 16 and operated in interlocked relationship with an accelerator pedal (not shown) located in the driver's seat to control the flow rate of the intake air, a throttle sensor 20 including an idle contact for detecting whether the throttle valve 18 is at idle opening or not and a potentiometer for generating a voltage output proportional to the opening of the throttle valve 18, a surge tank 22, an intake manifold pressure sensor 23 for detecting the intake manifold pressure from the pressure of the surge tank 22, and an injector 30 mounted on the intake manifold for injecting fuel toward the intake port of the engine 10. On the exhaust side, there are arranged an oxygen concentration sensor (lean sensor) 34 for detecting the air-fuel ratio from the concentration of the residual oxygen in the exhaust gase in order to control it to a given lean air-fuel ratio ($A/F \geqq 15$), and a catalytic converter 38 arranged midway in the exhaust pipe 36 downstream of the exhaust manifold 32. The engine further comprises a distributor 40 having a distributor shaft adapted to rotate in interlocked relationship with the rotation of the crank-shaft of the engine 10, a top dead center sensor 42 and a crank angle sensor 44 housed in the distributor 40 for producing a top dead center signal and a crank angle signal respectively with the rotation of the distributor shaft, a cooling water temperature sensor 46 arranged on the engine block for detecting the temperature of the cooling water, and a digital control circuit connected to the sensors, the injector 30 and a coil with ignitor 52.

The digital control circuit 54 is shown in further detail in FIG. 2 and includes basic processing means for determining from a map a basic injection amount for each engine cycle in accordance with the output of the intake manifold pressure sensor 23 and the output of the crank angle sensor 44, and compensation means for compensating for the basic injection amount in accordance with the output of the throttle sensor 20, the air-fuel ratio detected by the oxygen concentration sensor 34 and the temperature of the engine cooling water produced from the cooling water temperature sensor 47. A fuel injection amount is determined from these means, and a valve opening timing signal is applied to the injector 30.

Figure 4:
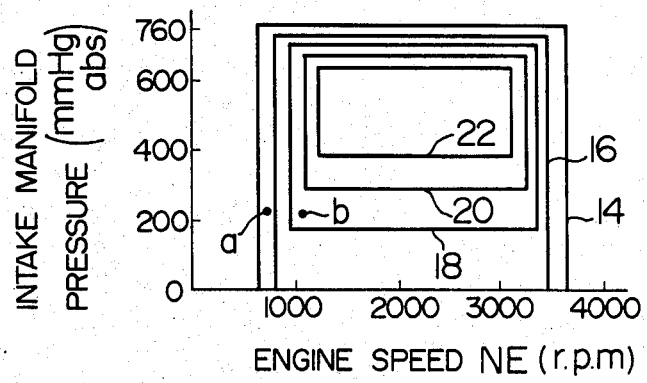
FIG. 4 is a map showing a set air-fuel ratio set in accordance with the intake manifold pressure and engine speed stored in advance in an ROM of the embodiment.

In the above-mentioned air-fuel control system using an electronically-controlled fuel injection system of intake manifold pressure type, the digital control circuit 54 includes after-idle enrichment compensation means (hereinafter referred to as "the LL enrichment compensation means") for effecting a fuel enrichment compensation by a predetermined amount when the idle switch of the throttle sensor 20 is turned off, throttle valve opening enrichment compensation means (hereinafter referred to as "the TA enrichment compensation means") for effecting enrichment compensation of the throttle valve opening detected by the output of the potentiometer of the throttle sensor 20 in accordance with an increased speed, intake manifold pressure enrichment compensation means (hereinafter referred to as "the PM enrichment compensation means") for effecting enrichment compensation of the intake manifold pressure in accordance with an increased speed with an integration value corresponding to the change rate of intake manifold pressure for a predetermined time detected from the output of the intake manifold pressure sensor 23 as a compensation factor, and air-fuel ratio increment compensation means hereinafter referred to as "the A/F increment compensation means") for effecting increment compensation corresponding to the set value obtained from the map of air-fuel ratio under steady operation set in a memory in accordance with the output of the intake manifold pressure sensor 23 and the engine speed obtained from the crank angle sensor 44 as shown in FIG. 4, so that acceleration is increased by combination of the fuel enrichment at these enrichment compensation means.

Figure 5:
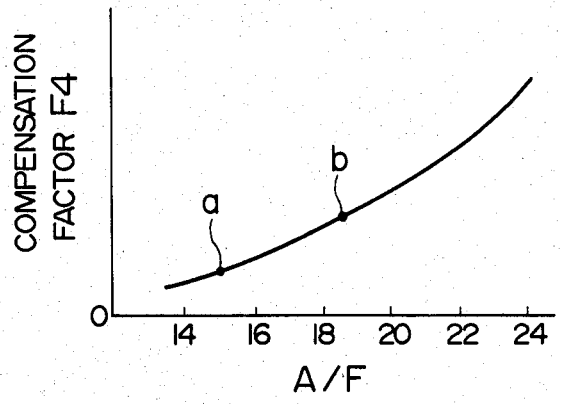
FIG. 5 is a map showing a compensation factor $F_4$ set in advance against the set air-fuel ratio immediately before acceleration which is used in the same embodiment.

The digital control circuit 54, on the other hand, includes a central processing unit (hereinafter referred to as "CPU") 60 made up of a microprocessor for performing various processing operations, an analog input port 62 with a multiplexer for converting analog signals applied thereto from the intake air temperature sensor 14, the potentiometer of the throttle sensor 20, the intake manifold pressure sensor 23, the oxygen concentration sensor 34 and the cooling water temperature sensor 46 into digital signals and applying them sequentially into CPU 60, a digital input port 64 for supplying the CPU 60 at a predetermined timing with the digital signals applied thereto from the idle contact of the throttle sensor 20, the top dead center sensor 42 and the crank angle sensor 44, a read-only memory (hereinafter referred to as "ROM") 66 for storing the control program for CPU or various constants shown in FIGS. 4 and 5, a random access memory (hereinafter referred to as "RAM") 68 for temporarily storing the operation data, etc. of CPU 60, a back-up random access memory (hereinafter referred to as "the back-up RAM") 70 capable of holding stored content by being supplied with power from an auxiliary power supply even after the engine is stopped, digital output port 72 for applying a signal to the injector 30, etc. at a predetermined timing, and a common bus 74 for connecting the component devices, as shown in detail in FIG. 2.

The operation of the air-fuel ratio control system configured as above will be explained below.

First, the digital control circuit 54 reads a basic injection time period TP (PM, NE) out of the map stored in advance in ROM 66 on the basis of the intake manifold pressure PM produced from the intake manifold pressure sensor 23 and the engine speed NE calculated from the output of the crank angle sensor 44 by use of the basic processing means.

Further, the digital control circuit 54 determines a compensation factor F from the respective compensation means in accordance with the outputs from sensors, and computes the final fuel injection time period TAU by compensating for the basic injection time period TP (PM, NE) by using the equation below.

$$TAU = TP(PM, NE) \times (1 + K \times F) \times A \times B \quad (1)$$

where K is a compensation magnification rate determined from the engine cooling water temperature, etc. for further compensation for the compensation factor F, A a target air-fuel ratio shown in FIG. 4 in which air-fuel ratios 14, 16, 18, 20 and 22 are shown with respect to the manifold pressure and engine speed, and B a compensation rate corresponding to the output of the oxygen concentration sensor 34 for compensating for the actual air-fuel ratio to a target air-fuel ratio by feedback.

The fuel injection signal corresponding to the fuel injection period TAU thus determined is applied to the injector 30, the injector 30 is opened for the fuel injection period TAU in synchronism with engine speed. The fuel is injected into the intake manifold 28 of the engine 10 thereby to supply the mixture gas of a predetermined air-fuel ratio into the cylinders of the engine 10.

The basic configuration and operation described above may be identical to those disclosed by Kobayashi et al U.S. application Ser. No. 617,476, filed on June 5, 1984 and assigned to the same assignee of the instant application, and therefore will not be described in detail.

The fuel enrichment for acceleration of engine speed in this embodiment is performed in the manner mentioned below by use of the above-mentioned various enrichment compensation means.

Specifically, when the accelerator pedal is depressed to turn off the idle switch of the throttle sensor 20 at the time of acceleration, an enrichment compensation is performed by the LL enrichment compensation means. The enrichment with this LL enrichment compensation means is actually performed in such a manner that a compensation factor for the LL enrichment compensation means, which is assumed to be $F_1$, is first set to a predetermined positive value (stored in ROM 66) followed by attenuation to zero at a predetermined rate at regular intervals of time or engine speed.

When the throttle valve 18 is opened further, the above-mentioned TA enrichment compensation means produces an enrichment corresponding to the rate of increase of the throttle valve opening degree TA as detected from the output of the potentiometer of the throttle sensor 20. The enrichment by this TA enrichment compensation means is performed specifically in such a manner that an integration value corresponding to the rate of change of the throttle valve opening degree TA for a predetermined time period is integrated, and this integrated value (positive value) is used as a compensation factor $F_2$ for the TA enrichment compensation means, which is attenuated to zero at a predetermined attenuation rate at regular intervals of time or engine speed.

Figure 3:
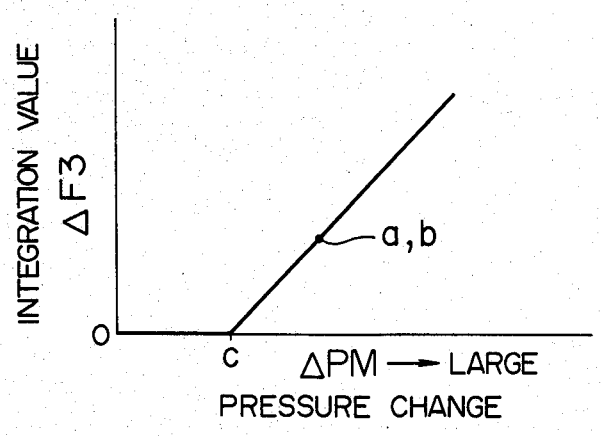
FIG. 3 is a map showing the relationship between the change in the intake manifold pressure used in the same embodiment and an integration value $\Delta F_3$.

When the intake manifold pressure PM begins to increase, the enrichment compensation for the intake manifold pressure PM is performed by the PM enrichment compensation means in accordance with the increased speed. The enrichment compensation by the PM enrichment compensation means is performed specifically in such a manner that in accordance with the rate of change ΔPM (equal to the latest intake manifold pressure PM minus a preceding intake manifold pressure PM' 0.2 seconds before) of the intake manifold pressure PM for every predetermined time (0.2 seconds), the integration value $\Delta F_3$ (FIG. 3) which is set for every such ΔPM in ROM 66 beforehand is integrated, and the integrated value (positive value) thus obtained is used as a compensation factor $F_3$ for the PM enrichment compensation means. The compensation factor $F_3$ is caused to attenuate to zero at a predetermined rate at regular intervals of time or engine speed when the intake manifold pressure PM is a constant.

Further, the A/F enrichment compensation means performs the enrichment compensation in accordance with the target air-fuel ratio A/F (FIG. 4) set in ROM 66 for steady operation immediately before the acceleration enrichment is effected by the respective enrichment compensation means. The A/F enrichment compensation means performs the enrichment specifically in such a manner that in accordance with the air-fuel ratio A/F set for the steady operation immediately before acceleration enrichment, a value which is set in advance in the map (FIG. 5) of ROM 66 corresponding to such an air-fuel ratio A/F set for the steady operation is read out and used as a compensation factor $F_4$ for the A/F enrichment compensation means, which is attenuated to zero, together with the attentuation of the compensation factor $F_3$ for the PM enrichment compensation means, at regular intervals of time or engine speed.

Figure 6:
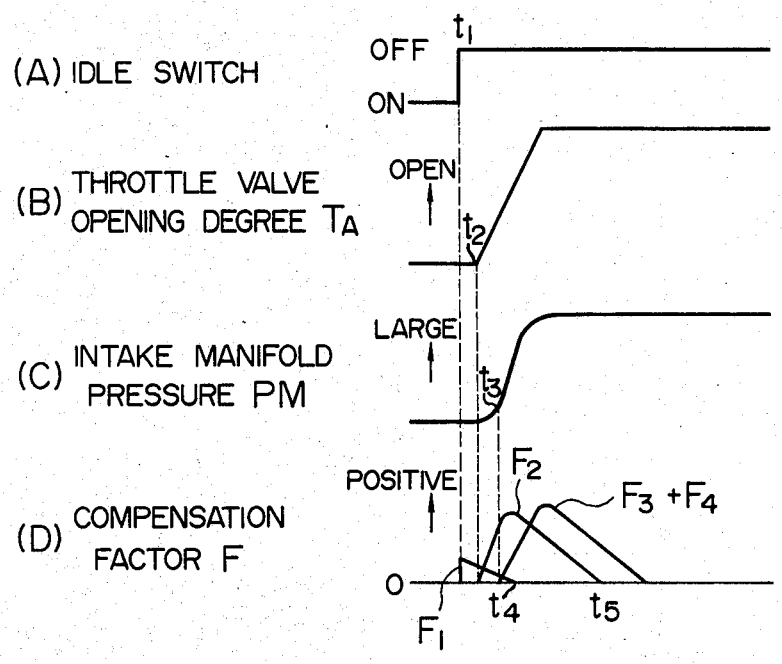
FIG. 6 is a time chart showing the manner in which fuel is enriched with acceleration according to the same embodiment.

The above-mentioned compensation factors $F_1$, $F_2$, $F_3$ and $F_4$ of the respective enrichment compensation means are substituted in an appropriate combination for the compensation factor F of the above equation (1). Specifically, the compensation factor $F_1$ for the LL enrichment compensation means is substituted into equation (1), followed by the substitution of the compensation factor $F_2$, and by the sum of the compensation factor $F_3$ and the compensation factor $F_4$, in this mentioned order. FIG. 6 shows changes in the compensation factors $F_1$, $F_2$ and $F_3+F_4$ with changes in intake manifold pressure PM, idle switch and the throttle valve opening degree TA. In the case of overlap of the enrichment compensation factors such as on the time axis shown in FIG. 6 (in the region of $t_2 \sim t_3 \sim t_4 \sim t_5$ in FIG. 6), an enrichment compensation means which has the largest compensation factor is selected and substituted into equation (1).

Figure 8:
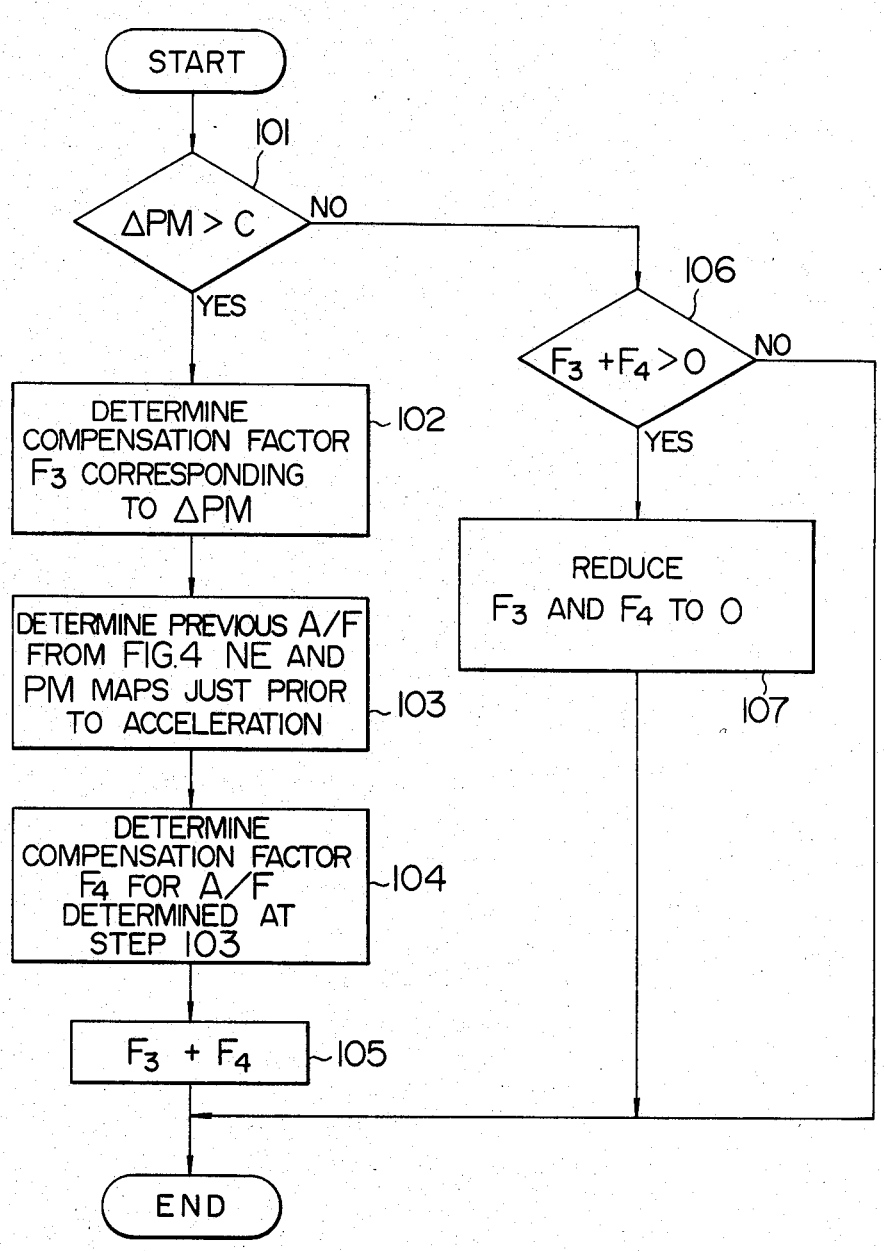
FIG. 8 is a flowchart for determining the compensation factors $F_3$ and $F_4$ according to the same embodiment.

FIG. 8 is a flowchart for determining the compensation factor sum $F_3+F_4$ for the PM enrichment compensation means and the A/F enrichment compensation means combined. Step 101 decides whether the change rate ΔPM of the intake manifold pressure PM is greater than a predetermined value C, and if it is greater than the predetermined value, the process is passed to step 102, where an integration value $\Delta F_3$ corresponding to the change rate ΔPM is determined from data (FIG. 3) stored in ROM 66, and this integration value $\Delta F_3$ is integrated to determine the compensation factor $F_3$. Step 103 determines the previously set air-fuel ratio A/F immediately before the acceleration enrichment from the map of the engine speed NE and intake manifold pressure PM of FIG. 4 stored in ROM 66. The previously set air-fuel ratio A/F used for calculating injection time period TAU is stored in RAM 68 to be used at the step 103. Step 104 determines the compensation factor $F_4$ in accordance with FIG. 5 from the previously set air-fuel ratio A/F determined at step 103, and step 105 adds the compensation factors $F_3$ and $F_4$ determined at the steps 102 and 104. If ΔPM is determined smaller than C at step 101, the process proceeds to step 106 to decide whether the sum $F_3+F_4$ previously determined at the step 105 is positive. If the sum is positive, attenuation follows to zero at a predetermined rate at regular intervals of time or engine speed. The sum $F_3+F_4$ of the compensation factors $F_3$ and $F_4$ thus determined is substituted into equation (1).

Figure 7:
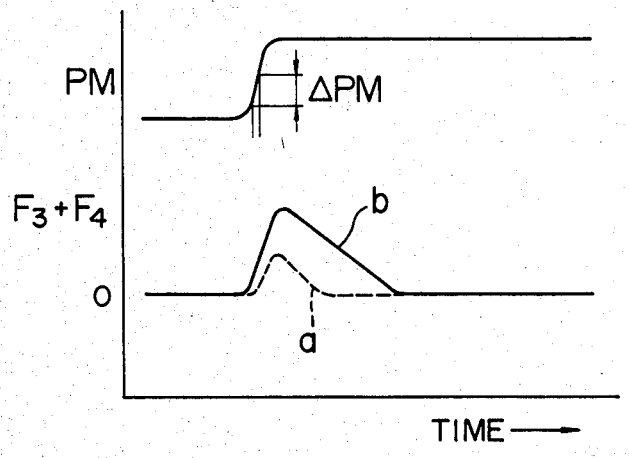
FIG. 7 is a time chart showing the difference in the sum of compensation factors $F_3$ and $F_4$ due to the difference in the set air-fuel ratio immediately before acceleration and the change in intake manifold pressure according to the same embodiment.

Assume that two set air-fuel ratios A/F immediately before acceleration are 15 shown by a point a, and 18.5 shown by a point b in FIG. 4. In these two cases, even though the change rate PM of the intake manifold pressure PM and the compensation factor $F_3$ determined from the integration value $\Delta F_3$ are the same, the compensation factor $F_4$ is different as shown in FIG. 5, so that the sum $F_3+F_4$ is different as indicated by the dashed line and the solid line in FIG. 7. When the engine is accelerated from the set air-fuel ratio A/F of 18.5 shown by b which represents a leaner state than the air-fuel ratio of 15, fuel is increased more than when the engine is accelerated from the stoichiometric air-fuel ratio of 15 indicated as the set air-fuel ratio by a.

According to the present embodiment comprising enrichment compensation means which depends on the set air-fuel ratio A/F immediately before acceleration, an acceleration enrichment corresponding to the set air-fuel ratio A/F immediately before acceleration is obtained, and therefore a superior acceleration performance is obtained without any fear of excessive enrichment regardless of the value of the set air-fuel ratio immediately before acceleration.

Instead of the combination of the A/F enrichment compensation means and the PM enrichment compensation means used in the aforementioned embodiment, the compensation factor $F_4$ may be added to the compensation factor $F_2$ for the TA enrichment compensation means so that when the sum $F_3+F_4$ of the compensation factor $F_4$ and the compensation factor $F_3$ for the PM enrichment compensation means exceeds the sum $F_2+F_4$, the sum $F_2+F_4$ may be replaced by the sum $F_3+F_4$.

Also, unlike in the aforementioned embodiment in which the compensation factor $F_4$ for the A/F increment compensation means is added to the compensation factor $F_3$ for the PM enrichment compensation means, the acceleration enrichment of fuel by the LL, TA and PM enrichment compensation means may be assumed to be set against the air-fuel ratio A/F of 16 for steady operation, so that the compensation factor $F_4$ obtained from the A/F enrichment compensation means is multiplied with the compensation factor $F_3$ for the PM enrichment compensation means to obtain an acceleration enrichment corresponding to the set air-fuel ratio A/F immediately before acceleration.

In the above-mentioned embodiment, a normal injection pulse duration synchronous with the engine crank angle for controlling the valve-opening time of the injector 30 is compensated for to obtain an acceleration enrichment. Alternatively, an acceleration pulse not synchronous with the engine crank angle may be generated in accordance with a predetermined acceleration enrichment as mentioned with reference to the above-described embodiment immediately after a decision that an acceleration is involved.

Further, in place of the electronically-controlled fuel injecton system of intake manifold pressure type used in the air-fuel ratio control system according to the aforementioned embodiment, an electronically-controlled fuel injection system of intake air amount type may be incorporated to attain an acceleration enrichment with an intake air amount instead of an intake manifold pressure.

Furthermore, the oxygen concentration sensor 34 used in the air-fuel control system according to the aforementioned embodiment for controlling the air-fuel ratio of the mixture gas by monitoring the residual oxygen concentration of the exhaust gas may be eliminated so as to supply fuel in accordance with the air-fuel ratio set on the basis of the engine speed and the intake manifold pressure or intake air amount by means of a map as shown in FIG. 4.

It will be understood from the foregoing description that according to the present invention, there is provided an air-fuel ratio control system comprising basic processing means for determining a basic injection amount in accordance with the engine speed and the engine intake manifold pressure or intake air amount to set the air-fuel ratio of the mixture gas supplied to the engine and compensation means for compensating for the basic injection amount in accordance with the engine operating conditions to determine a fuel injection amount for controlling the air-fuel ratio of the mixture gas, in which the compensation means includes air-fuel ratio enrichment compensation means for compensating for the fuel enrichment at the time of acceleration in accordance with the set air-fuel ratio immediately before acceleration, so that regardless of the extent by which the set air-fuel ratio during steady operation is smaller or larger than the stoichiometric air-fuel ratio, the enrichment compensation effected by the air-fuel ratio enrichment compensation means corresponding to the set air-fuel ratio immediately before acceleration permits an acceleration enrichment meeting the set air-fuel ratio immediately before acceleration, thereby supplying the engine with a mixture gas of a desired air-fuel ratio containing a sufficient amount of fuel to attain a satisfactory acceleration performance. Also, since the fuel for the desired air-fuel ratio is controlled to proper amount, the amount of carbon monoxide in the exhaust gas does not increase extremely by oversupply of fuel, thereby contributing to an improved exhaust gas purification performance.

What is claimed is:

1. An apparatus for controlling an air-fuel ratio of a mixture to be supplied to an engine, comprising:

means for sensing at least one operating parameter of said engine;

means for storing a predetermined relationship between at least one operating parameter of said engine and a plurality of air-fuel ratios leaner than a stoichiometric air-fuel ratio;

first memory means for storing a target air-fuel ratio; and control means for:

(A) determining if an acceleration of said engine is greater than a predetermined threshold, (B) during a steady-state operation, where an acceleration of the engine is less than said predetermined threshold:

(1) selecting a target air-fuel ratio one of said plurality of air-fuel ratios from said storing means, said selecting being accomplished as a function of at least one of said at least one operating parameter during each engine cycle of a definite length, and (2) storing said target air-fuel ratio in said first memory means during each said engine cycle, and (C) during an acceleration operation where said acceleration of the engine is greater than said predetermined threshold:

(1) reading said selected target air-fuel ratio from said first memory means, this read target air-fuel ratio indicating an air-fuel ratio existing before said acceleration operation, and (2) varying an amount of fuel supplied to said engine based on said read target air-fuel ratio.

2. An apparatus according to claim 1, wherein said operating parameters sensing means includes first means for sensing an intake condition of said engine and second means for sensing a rotational condition of said engine, and wherein said storing means includes second memory means for storing therein said plurality of target air-fuel ratios as a function of both of an intake condition and a rotational speed of said engine.

3. An apparatus according to claim 1, wherein said control means for determining an acceleration includes change detecting means for detecting a change in at least one of an opening degree of a throttle valve of said engine and the sensed intake condition, and wherein said fuel varying means includes third memory means for storing a plurality of fuel increase values as a function of air-fuel ratios, and means for determining an amount of fuel to be increased in accordance with said detected change and one of said stored fuel increase values.

4. An apparatus as in claim 1 wherein said storing means is a read only memory which stores a three dimensional map.

5. An apparatus as in claim 4 wherein said at least one operating parameter of said storing means includes engine speed and intake manifold pressure.

6. An apparatus as in claim 5 wherein said first memory means is a random access memory.

7. An apparatus according to claim 1 wherein said control means includes:

first storage means for storing therein a plurality of enrichment factors as a function of a plurality of air-fuel ratios of a mixture to be supplied to said engine during said steady state operation of said engine, said enrichment factors being related to an additional fuel injection amount; and means for accessing one of said stored enrichment factors from said first storage means in response to one of said air-fuel ratios of mixture supplied to said engine just prior to the acceleration of said engine stored in said first memory means, such derived enrichment factor being used to determine an additional fuel injection amount.

8. An apparatus according to claim 1, wherein said storing means stores air-fuel ratios which are in the range of between 15 and 22, and said operating parameter sensing means includes a lean sensor for sensing an air-fuel ratio of exhaust gas which is leaner than a ratio of 15.

9. An apparatus according to claim 1, wherein said fuel supplying means includes ROM means for storing basic injection periods relating to intake conditions and rotational conditions of the engine and for reading out one of said periods in response to said sensed conditions.

10. An apparatus according to claim 1, wherein said enrichment compensation means includes:

(a) first compensation means, including a throttle sensor idle switch, for compensating the basic injection amount by a first predetermined compensation factor ($F_1$) upon detection of turn-off operation of said idle switch;

(b) second compensation means for integrating a rate of change of throttle valve opening degree and for compensating factor ($F_2$) of such integrated change rate;

(c) third compensation means, for storing third compensation factors ($F_3$) relating to rates of change of intake manifold pressure, and for sensing a current intake manifold pressure to read out a corresponding third compensation factor ($F_3$) and compensating the basic injection amount by the read-out third compensation factor;

(d) fourth compensation means for storing fourth compensation factors ($F_4$) relating to said target air-fuel ratio; and (e) means for decreasing an amount of compensation of each of said first, second, third and fourth compensation means at predetermined rates at regular intervals of one of time and of engine speed respectively; and wherein said enrichment compensation means is also for supplying said engine with fuel in a consequential injection period obtained from the compensation of the basic injection amount effected by said first to fourth compensation means.

11. An apparatus as in claim 1 wherein said control means for varying an amount of fuel includes means for storing a plurality of predetermined air-fuel compensation factors as a function of a plurality of target air-fuel ratios.

12. An apparatus according to claim 9, wherein said control means includes:

first compensation means, including a throttle sensor idle switch, for compensating the read-out basic injection period by a first predetermined compensation factor ($F_1$) upon detection of turn-off operation of said idle switch;

(b) second compensation means for integrating a rate of change of throttle valve opening degree and for compensating the read-out basic injection period by a second compensation factor ($F_2$) of integrated change rate;

(c) third compensation means, for storing third compensation factors ($F_3$) relating to rates of change of intake manifold pressure, and for sensing a current intake manifold pressure to read out a corresponding third compensation factor ($F_3$) and compensating the read-out basic injection period by the read-out third compensation factor;

(d) fourth compensation means, for storing fourth compensation factors ($F_4$) relating to said target air-fuel ratios for compensating the read-out basic injection period by a fourth compensation factor ($F_4$) corresponding to said selected target air-fuel ratio; and (e) means for decreasing an amount of compensation of each of said first, second, third and fourth compensation means at predetermined rates at regular intervals of one of time and of engine speed respectively.

13. An apparatus according to claim 9, wherein said fuel amount increasing means includes:

first compensation means including a throttle sensor idle switch for incrementally compensating the read-out basic injection time period by a first predetermined compensation factor ($F_1$) upon detection of turn-off operation of said idle switch, in order to define a first-compensated injection period;

second compensation means for integrating a rate of change of throttle valve opening degree and incrementally compensating the first-compensated injection period by a second compensation factor ($F_2$) of integrated change rate in order to define a second-compensated injection period;

third compensation means for storing third compensation factors ($F_3$) relating to change rates of intake manifold pressure, and for sensing a current intake manifold pressure of the engine to read-out a corresponding third compensation factor and incrementally compensating the second-compensated injection period by the read-out third compensation factor in order to define a third-compensated injection period; and fourth compensation means for storing fourth compensation factors ($F_4$) relating to said target air-fuel ratios, for incrementally compensating the third compensation injection period by a fourth compensation factor ($F_4$) corresponding to said selected target air-fuel ratio in order to define a fourth-compensation injection period.

14. An apparatus according to claim 12, wherein said first, second, third and fourth compensation means are also for sequentially compensating the the read-out basic injection period.

15. An apparatus according to claim 12, wherein said fuel amount varying means includes:

means for summing said second compensation factor and said fourth compensation factor to produce a first sum factor for compensating the read-out basic injection period;

means for summing said third compensation factor and said fourth compensation factor to produce a second sum factor for compensating the read-out basic injection period;

means for comparing magnitudes of said first and second sum factors; and means for compensating the read-out basic injection period by said second sum factor, in response to said comparing means when said second sum factor becomes larger than said first sum factor, after compensating the read-out basic injection period by said first sum factor.

16. An apparatus according to claim 12, wherein said control means includes means for summing said corresponding read-out third compensation factor and said fourth compensation factor to compensate the read-out basic injection period, to improve engine driveability and improving exhaust gas purification by keeping the air-fuel ratio of the engine at a desired ratio during engine accelerating operation irrespective of possible various air-fuel ratios before the acceleration.

17. An apparatus according to claim 16, wherein said fuel supplying means is also for supplying said engine with fuel during the consequential injection period synchronously with rotation of the engine.

18. A method for controlling an air-fuel ratio of a mixture to be applied to an engine, comprising the steps of:

continually sensing a plurality of operating parameters of an engine;

looking up in a memory means, which includes prestored air-fuel ratios as a function of at least one of said sensed operating parameters, a target air-fuel ratio during each engine cycle of a definite length;

storing each said target air-fuel ratio during each said engine cycle during steady state operation;

determining an acceleration of said engine which is greater than a predetermined threshold of acceleration amount;

reading said stored, target air-fuel ratio stored in said storing step when said acceleration is determined to be greater than said predetermined threshold, this read target air-fuel ratio indicating an air-fuel ratio existing previously to said determined acceleration operation; and varying an amount of fuel supplied to said engine based on said read air-fuel ratio.

19. A method as in claim 18 wherein said varying step further includes looking up a compensation factor in a second memory means as a function of said read target air-fuel ratio.

20. A method as in claim 18 wherein said prestored air-fuel ratios are leaner than stoichiometric.

21. A method as in claim 18 wherein said varying step includes the steps of:

determining if an idle switch of a throttle is turned off, and producing a first compensation factor indicative thereof;

producing a second compensation factor proportional to a rate of change of a throttle opening degree;

producing a third compensation factor proportional to a change in intake manifold pressure per unit predetermined time; and producing a fourth compensation factor based on said read target air-fuel ratio before said acceleration of said engine by using said read target air-fuel ratio as a parameter for a look-up table.

22. A method as in claim 21 comprising the further step of determining which, among the various compensation factors has a highest value, and using that compensation factor.

23. A method as in claim 22 comprising the further step of summing together said third compensation factor and said fourth compensation factor to form a fifth compensation factor.

* * * * *